US010654285B2

(12) United States Patent
Hoshii

(10) Patent No.: US 10,654,285 B2
(45) Date of Patent: *May 19, 2020

(54) PRINTING CONTROL APPARATUS, PRINTING APPARATUS, AND PRINTING CONTOL METHOD

(71) Applicant: SEIKO EPSON CORPORATION, Tokyo (JP)

(72) Inventor: Jun Hoshii, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/145,284

(22) Filed: Sep. 28, 2018

(65) Prior Publication Data

US 2019/0100026 A1 Apr. 4, 2019

(30) Foreign Application Priority Data

Sep. 29, 2017 (JP) ..... 2017-191219

(51) Int. Cl.
*B41J 2/21* (2006.01)
*B41J 2/045* (2006.01)
(Continued)

(52) U.S. Cl.
CPC ..... *B41J 2/2135* (2013.01); *B41J 2/04505* (2013.01); *B41J 2/04573* (2013.01); *B41J 2/04581* (2013.01); *B41J 2/04586* (2013.01); *B41J 2/04588* (2013.01); *B41J 2/04593* (2013.01); *B41J 2/2054* (2013.01); *B41J 2/51* (2013.01)

(58) Field of Classification Search
CPC .... B41J 2/04586; B41J 2/2132; B41J 2/2135; B41J 2/04505; B41J 29/38; B41J 2/04508
See application file for complete search history.

(56) References Cited

U.S. PATENT DOCUMENTS

2011/0148956 A1 6/2011 Nakahara
2011/0221800 A1 9/2011 Ikeda
(Continued)

FOREIGN PATENT DOCUMENTS

EP 0955174 A2 11/1999
JP 11-320926 A 11/1999
(Continued)

*Primary Examiner* — Jannelle M Lebron
(74) *Attorney, Agent, or Firm* — Global IP Counselors, LLP

(57) ABSTRACT

A printing control apparatus is configured to control printing using a print head provided with, on different head chips, a plurality of nozzle groups including a first nozzle group and a second nozzle group configured to eject ink of a same color, with at least a portion of a formation range of each of the nozzle groups overlapping each other. The different head chips is disposed in a direction that crosses an alignment direction of nozzles. The printing control apparatus includes a halftone processing unit configured to generate halftone data specifying a presence or absence of dots for each pixel serving as data to drive the nozzle groups based on image data. The halftone processing unit is configured to generate first halftone data to drive the first nozzle group and second halftone data to drive the second nozzle group in an uncorrelated manner.

6 Claims, 8 Drawing Sheets

(51) Int. Cl.
*B41J 2/205* (2006.01)
*B41J 2/51* (2006.01)

(56) References Cited

U.S. PATENT DOCUMENTS

| | | | | |
|---|---|---|---|---|
| 2012/0206525 | A1 | 8/2012 | Tanase et al. | |
| 2014/0292860 | A1 | 10/2014 | Furuhata | |
| 2017/0157919 | A1* | 6/2017 | Katsuyama | B41J 2/04586 |
| 2018/0207947 | A1* | 7/2018 | Yoshikawa | B41J 2/2103 |

FOREIGN PATENT DOCUMENTS

| | | | |
|---|---|---|---|
| JP | 2001-001510 | A | 1/2001 |
| JP | 2009-018476 | A | 1/2009 |
| JP | 2010-000684 | A | 1/2010 |
| JP | 2011-126264 | A | 6/2011 |
| JP | 2013-136250 | A | 7/2013 |
| JP | 2014-008660 | A | 1/2014 |

* cited by examiner

PRINTING CONTROL APPARATUS, PRINTING APPARATUS, AND PRINTING CONTOL METHOD

CROSS-REFERENCE TO RELATED APPLICATIONS

This application claims priority to Japanese Patent Application No. 2017-191219 filed on Sep. 29, 2017. The entire disclosure of Japanese Patent Application No. 2017-191219 is hereby incorporated herein by reference.

BACKGROUND

Technical Field

The invention relates to a printing control apparatus, a printing apparatus, and a printing control method.

Related Art

An ink jet color printing apparatus provided with rows of nozzles (nozzle rows) for ink that are symmetrically disposed on a print head is known. The nozzle rows are each dedicated to one of the ink colors, i.e., black (K), cyan (C), magenta (M), and yellow (Y), and are disposed in correspondence with each color in the order of KCMYYMCK along a movement direction of the print head (refer to FIG. 7 in JP-A-11-320926).

When a plurality of nozzle rows corresponding to ink of the same color (K, for example) exist as in JP-A-11-320926, processing has been performed under the premise that the plurality of nozzle rows corresponding to ink of the same color are ideally disposed in terms of design. That is, image processing has been performed with the plurality of nozzle rows corresponding to ink of the same color regarded as a substantially single nozzle row (one as a whole).

Nevertheless, in an actual product, the plurality of nozzle rows corresponding to ink of the same color are not necessarily ideally disposed due to deviation and inclination during product assembly. When the arrangement of the plurality of nozzle rows corresponding to the same color deviates from the ideal arrangement (hereinafter "error between nozzle groups"), partial coverage differences and graininess differences on a printing medium caused by the ink occur, and such differences in coverage and graininess may be visible as unevenness in a print result. Additionally, while such an error between nozzle groups can be reduced close to zero by increasing product assembly accuracy, increasing the accuracy of assembly of each individual product results in an increase in cost in various aspects such as time, equipment, parts, and personnel, and thus, is no easy task.

SUMMARY

The invention provides a printing control apparatus, a printing apparatus, and a printing control method that contribute to stabilizing and improving a print quality.

An aspect according to the invention provides a printing control apparatus configured to control printing using a print head provided with, on different head chips, a plurality of nozzle groups including a first nozzle group and a second nozzle group configured to eject ink of a same color, with at least a portion of a formation range of each of the nozzle groups corresponding to ink of the same color and formed on the different head chips overlapping each other, and the different head chips being disposed in a direction that crosses an alignment direction of nozzles of each of the nozzle groups. The printing control apparatus includes a halftone processing unit configured to generate halftone data specifying a presence or absence of dots for each pixel serving as data to drive the nozzle groups based on image data. The halftone processing unit is further configured to generate first halftone data to drive the first nozzle group and second halftone data to drive the second nozzle group in an uncorrelated manner.

Conventionally, a plurality of nozzle groups corresponding to ink of the same color have been regarded as a single nozzle group (one as a whole), and image processing (halftone processing and the like) for driving this nozzle group was performed. In such conventional art, differences in print quality between a case in which there is an error between nozzle groups and a case in which there is no error between nozzle groups in the plurality of nozzle groups corresponding to ink of the same color tend to become significant. In contrast, the printing control apparatus according to the invention is configured to generate first halftone data and second halftone data for respectively driving the first nozzle group and the second nozzle group corresponding to ink of the same color in an uncorrelated manner. Thus, without any correlation between a distribution of dots ejected by driving the first nozzle group and a distribution of dots ejected by driving the second nozzle group, the difference in print quality between a case in which there is an error between nozzle groups and a case in which there is no error between nozzle groups in the plurality of nozzle groups corresponding to ink of the same color decreases, stabilizing the print quality (making the print quality uniform between products).

According to an aspect of the invention, the halftone processing unit is further configured to generate the first halftone data and the second halftone data that drive either one of the first nozzle group and the second nozzle group corresponding to an image having a brightness of a predetermined highlight range in the image data.

According to the configuration, the printing of a highlight portion where deterioration of graininess is particularly readily visible in the print result uses either one of the first nozzle group and the second nozzle group. This makes it possible to avoid deterioration of graininess in the highlight portion when there is an error between nozzle groups in the first nozzle group and the second nozzle group.

According to an aspect of the invention, the halftone processing unit is further configured to generate one of the first halftone data and the second halftone data by a dither method, and generate the other of the first halftone data and the second halftone data by an error diffusion method.

According to the configuration, one of the first halftone data and the second halftone data is generated by the dither method and the other is generated by an error diffusion method, making it possible to drive the first nozzle group and the second nozzle group by halftone data that is not correlated.

According to an aspect of the invention, each nozzle constituting the nozzle group is configured to eject a first size dot and a second size dot smaller than the first size dot, and the halftone processing unit is further configured to generate one of the first halftone data and the second halftone data as halftone data specifying a presence or absence of the first size dot, and generate the other of the first halftone data and the second halftone data as halftone data specifying a presence or absence of the second size dot.

According to the configuration, the first size dot is ejected by one of the first nozzle group and the second nozzle group, and the second size dot is ejected by the other. As a result, compared to a case in which each of the nozzle groups is configured to eject dots of both a first size and a second size, deviation between a formation position of the first size dot and a formation position of the second size dot in the print result is readily suppressed.

Achievement of the technical concept of the invention is not limited to the printing control apparatus. Other examples include a printing apparatus configured to execute printing using the print head, the printing apparatus including a halftone processing unit configured to generate halftone data specifying a presence or absence of dots for each pixel serving as data to drive the nozzle groups, based on image data, the halftone processing unit being further configured to generate first halftone data to drive a first nozzle group included in the plurality of nozzle groups corresponding to ink of the same color, and second halftone data to drive a second nozzle group included in the plurality of nozzle groups, in an uncorrelated manner. Further, methods (a printing method, a printing control method) that include processing executed by the printing apparatus or the printing control apparatus, a program that executes these methods on a computer, and a computer readable storage medium storing the program may also be respectively established as still further aspects of the invention.

BRIEF DESCRIPTION OF THE DRAWINGS

Referring now to the attached drawings which form a part of this original disclosure.

DETAILED DESCRIPTION OF EXEMPLARY EMBODIMENTS

Figure 1:
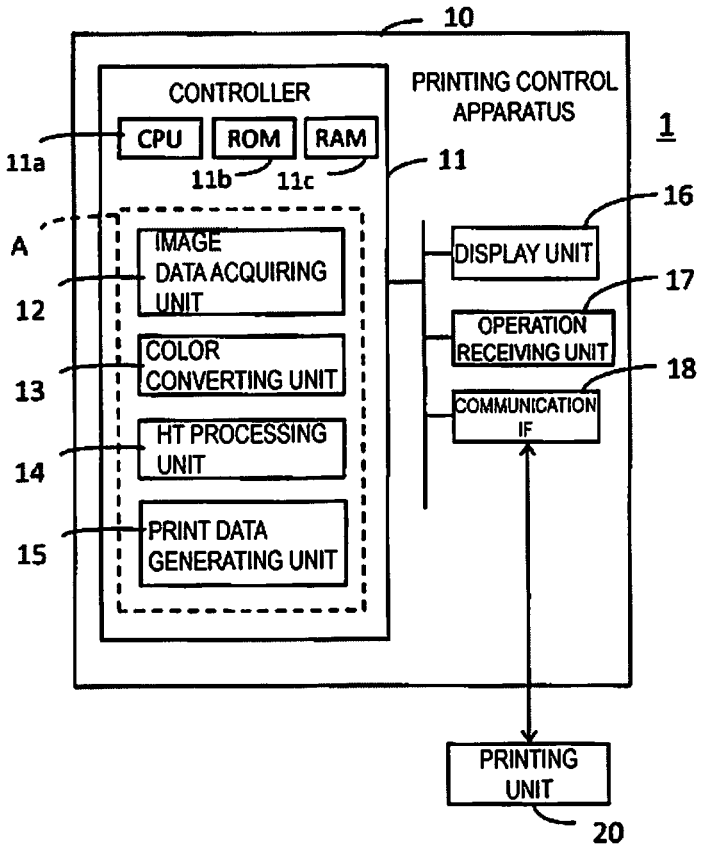
FIG. 1 is a simplified diagram illustrating an apparatus configuration according to a first embodiment.

Exemplary embodiments of the invention are described below with reference to the drawings. Note that each of the drawing is merely an illustration for explaining the exemplary embodiments.

1. Outline Description of Apparatus Configuration

FIG. 1 illustrates an apparatus configuration according to a first embodiment in a simplified manner. A printing control apparatus 10 includes, for example, a control unit 11, a display unit 16, an operation receiving unit 17, a communication interface (IF) 18, and the like. The printing control apparatus 10 is, for example, implemented by a personal computer (PC) or an information processing apparatus having the same level of processing capacity as a PC. Further, hardware configured to implement the control unit 11 according to the first embodiment may be referred to as the printing control apparatus. The printing control apparatus may be referred to as an image processing device.

The control unit 11 is provided with one or a plurality of integrated circuits (ICs) including a CPU 11*a*, a ROM 11*b*, a RAM 11*c*, and the like, or storage media such as other memory and a hard disk drive, and the like, as appropriate. In the control unit 11, the CPU 11*a* controls a behavior of the printing control apparatus 10 by executing arithmetic processes in accordance with a program stored on the ROM 11*b* and the like using the RAM 11*c* and the like as a work area. The control unit 11 is equipped with program A, and achieves each function such as an image data acquiring unit 12, a color converting unit 13, a halftone (HT) processing unit 14, and a print data generating unit 15 in accordance with program A. Program A can be referred to as an image processing program, a print control program, a printer driver, and the like.

The communication IF 18 is a general term for an IF that allows the control unit 11 to execute communication with sources outside the printing control apparatus 10 in conformity with predetermined communication standards. The display unit 16 serves to display visual information, and includes a liquid crystal display (LCD), an organic electroluminescence (EL) display, and the like, for example. The display unit 16 may include a display and a drive circuit for driving the display. The operation receiving unit 17 serves to receive operations by a user, and is implemented by physical buttons, a touch panel, a mouse, a keyboard, and the like, for example. The touch panel may be implemented as one function of the display unit 16. Further, the display unit 16 may include the operation receiving unit 17 and be referred to as an operation panel and the like.

The printing control apparatus 10 is communicably coupled with a printing unit 20 via the communication IF 18. The printing unit 20 is a mechanism configured to execute printing based on print data generated by the printing control apparatus 10 (control unit 11). The printing control apparatus 10 and the printing unit 20 may be devices independent of each other. When the printing control apparatus 10 and the printing unit 20 are independent devices, the printing unit 20 can be referred to as a printing apparatus, and a configuration that includes the printing control apparatus 10 and the printing unit 20 can be referred to as a printing system 1.

Alternatively, the printing control apparatus 10 and the printing unit 20 may, as a whole, be included in a substantially single device. When the printing control apparatus 10 and the printing unit 20 are included in a single device, a configuration (single device) that includes the printing control apparatus 10 and the printing unit 20 can be referred to as the printing apparatus 1. The printing apparatus 1 has at least a printing function. Thus, the printing apparatus 1 may be a multifunction machine having a printing function as well as a plurality of other functions such as a scanner and facsimile.

Figure 2:
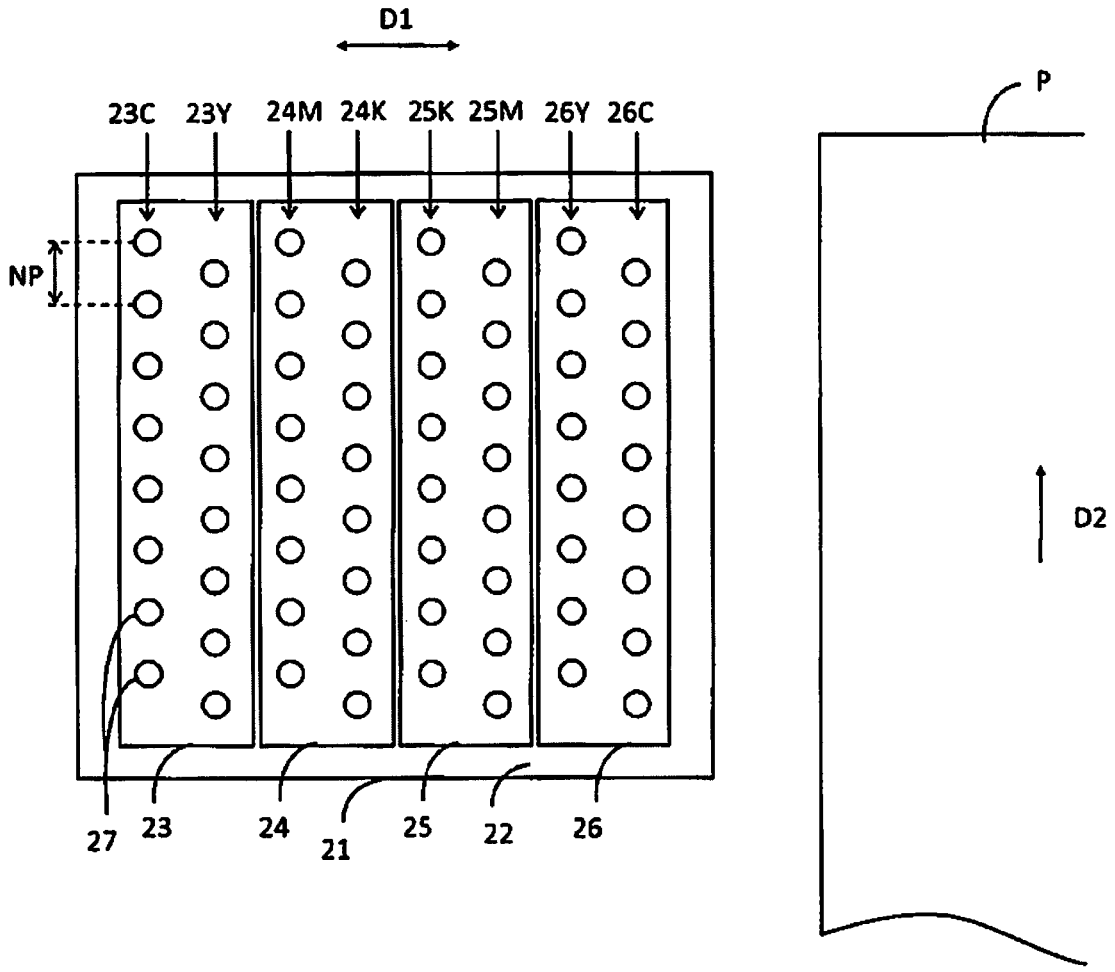
FIG. 2 is a simplified diagram illustrating a print head and a printing medium.

FIG. 2 illustrates a print head 21 and a printing medium P of the printing unit 20 in a simplified manner. The printing unit 20, as a basic configuration, includes the print head 21 configured to eject a liquid such as ink, a carriage (not illustrated) for moving the print head 21, and a transport mechanism (not illustrated) for transporting the printing medium P. The print head 21 may be referred to as a recording head, a printing head, a liquid ejection (spray) head, and the like. The printing medium P is typically paper, but may be a material other than paper as long as configured to record by ejection of a liquid.

The carriage, as known, moves the print head 21 along a predetermined main scanning direction D1 with the print head 21 mounted. The transport mechanism, as known, transports the printing medium P along a transport direction D2 that crosses the main scanning direction D1. Here, the crossing is basically orthogonal. However, in the first embodiment, expressions such as orthogonal, parallel, and equally spaced apart may not mean orthogonal, parallel, or equally spaced apart in a strict sense due to various errors, inclination, and the like in the printing unit 20 as a product.

The print head 21 includes a plurality of nozzles 27 for ejecting ink and the like supplied from an ink cartridge (not illustrated). The reference sign 22 denotes a nozzle surface 22 where the nozzles 27 open, and FIG. 2 illustrates an example of an array of the nozzles 27 on the nozzle surface 22. The print head 21 is provided with a plurality of head chips 23, 24, 25, 26 assembled to the print head 21. The head chips 23, 24, 25, 26 are each a component made of metal, ceramic, wiring, and the like, and each includes the plurality of nozzles 27, a flow path configured to supply a liquid to each of the nozzles 27, an actuator for ejecting a liquid from each of the nozzles 27, and the like.

In the example illustrated in FIG. 2, the head chips 23, 24, 25, 26 each include two nozzle groups. Specifically, the head chip 23 includes the nozzle groups 23C, 23Y, the head chip 24 includes the nozzle groups 24M, 24K, the head chip 25 includes the nozzle groups 25K, 25M, and the head chip 26 includes the nozzle groups 26Y, 26C. The nozzle groups 23C, 23Y, 24M, 24K, 25K, 25M, 26Y, 26C each include the plurality of nozzles 27 equally spaced apart in a predetermined direction (nozzle alignment direction). The spacing between the nozzles 27 of a single nozzle group in the nozzle alignment direction is expressed as a nozzle pitch NP.

In a single head chip, the two nozzle groups are formed in a deviated manner by a distance of NP/2 in the nozzle alignment direction. Further, the plurality of head chips 23, 24, 25, 26, are arranged along the main scanning direction D1 to make the nozzle alignment direction parallel to the transport direction D2. That is, the plurality of head chips 23, 24, 25, 26, are disposed in a direction that crosses the nozzle alignment direction. In the example illustrated in FIG. 2, the nozzle groups 23C, 23Y, 24M, 24K, 25K, 25M, 26Y, 26C each include the plurality of nozzles 27 linearly aligned, and thus the nozzle groups may be referred to as nozzle rows. However, the plurality of nozzles 27 constituting each of the nozzle groups may be disposed in a zig-zag form (in a staggered manner) along the nozzle alignment direction, for example.

In the example illustrated in FIG. 2, the nozzles 27 constituting the nozzle group 23C each eject the C ink, the nozzles 27 constituting the nozzle group 23Y each eject the Y ink, the nozzles 27 constituting the nozzle group 24M each eject the M ink, and the nozzles 27 constituting the nozzle group 24K each eject the K ink. Further, the nozzles 27 constituting the nozzle group 25K each eject the K ink, the nozzles 27 constituting the nozzle group 25M each eject the M ink, the nozzles 27 constituting the nozzle group 26Y each eject the Y ink, and the nozzles 27 constituting the nozzle group 26C each eject the C ink. That is, in the first embodiment, in the print head 21, the nozzle groups (nozzle rows) corresponding to each color are symmetrically disposed along the main scanning direction D1 (in a symmetrical array of CYMKKMYC in the example illustrated in FIG. 2). Note that the order of the colors when the nozzle groups (nozzle rows) corresponding to each color are symmetrically disposed along the main scanning direction D1 does not need to be as illustrated in FIG. 2.

Here, in the nozzle groups 23C, 26C corresponding to the C ink, one of the nozzle groups 23C, 26C may be referred to as a first nozzle group configured to eject ink (the C ink) of the same color, and the other may be referred to as a second nozzle group configured to eject ink (the C ink) of the same color.

Similarly, in the nozzle groups 23Y, 26Y corresponding to the Y ink, one of the nozzle groups 23Y, 26Y may be referred to as a first nozzle group configured to eject ink (the Y ink) of the same color, and the other may be referred to as a second nozzle group configured to eject ink (the Y ink) of the same color.

Similarly, in the nozzle groups 24M, 25M corresponding to the M ink, one of the nozzle groups 24M, 25M may be referred to as a first nozzle group configured to eject ink (the M ink) of the same color, and the other may be referred to as a second nozzle group configured to eject ink (the M ink) of the same color.

Similarly, in the nozzle groups 24K, 25K corresponding to the K ink, one of the nozzle groups 24K, 25K may be referred to as a first nozzle group configured to eject ink (the K ink) of the same color, and the other may be referred to as a second nozzle group configured to eject ink (the K ink) of the same color.

Then, the first nozzle group and the second nozzle group configured to eject ink of the same color are formed on mutually different head chips.

In such a configuration, as understood from FIG. 2, the formation ranges of the first nozzle group and the second nozzle group corresponding to ink of the same color overlap each other with a displacement by NP/2 in the nozzle alignment direction. For example, in the nozzle group 23C, 26C corresponding to the C ink, the nozzle group 23C and the nozzle group 26C are displaced by NP/2 in the nozzle alignment direction. In other words, a state in which the formation ranges of the first nozzle group and the second nozzle group corresponding to ink of the same color are displaced by NP/2 in the nozzle alignment direction (transport direction D2) is an "ideal arrangement (an arrangement without an error between nozzle groups)" of the first nozzle group and the second nozzle group.

For example, when a nozzle resolution (npi: number of nozzles per inch) in the nozzle alignment direction of a single nozzle group is 300 npi (that is, NP=1/300 [inch]), the nozzle resolution in the nozzle alignment direction of the first nozzle group and the second nozzle group corresponding to ink of the same color combined is double that value (600 npi) in the ideal arrangement. However, it is difficult to implement of such an ideal arrangement in a strict sense by the entire print heads 21 mass produced with the plurality of head chips assembled to the print heads 21. In an extreme example, when the formation ranges of the first nozzle group and the second nozzle group corresponding to ink of the same color coincide (completely overlap) in the nozzle alignment direction (transport direction D2), the nozzle resolution in the nozzle alignment direction of each of the first nozzle group and the second nozzle group is the same as the nozzle resolution in the nozzle alignment direction of the first nozzle group and the second nozzle group combined (both being 300 npi).

The printing unit 20 alternately executes liquid ejection (scanning) by the print head 21 in association with movement of the print head 21 by the carriage, and transport (so-called paper-feeding) of a predetermined distance of the printing medium P by the transport mechanism based on print data to print on the printing medium P. A scan by the print head 21 is also referred to as a pass. The printing unit 20 (or a configuration (reference numeral 1) that includes the printing unit 20) may be referred to as an ink jet printer. The liquid (droplet) ejected from the nozzles 27 by the print head 21 is referred to as a dot. However, in the first embodiment, the expression "dot" is used for convenience when describing image processing and print control processing in a preliminary stage before dots are ejected.

2. Printing Control Processing

Figure 3:
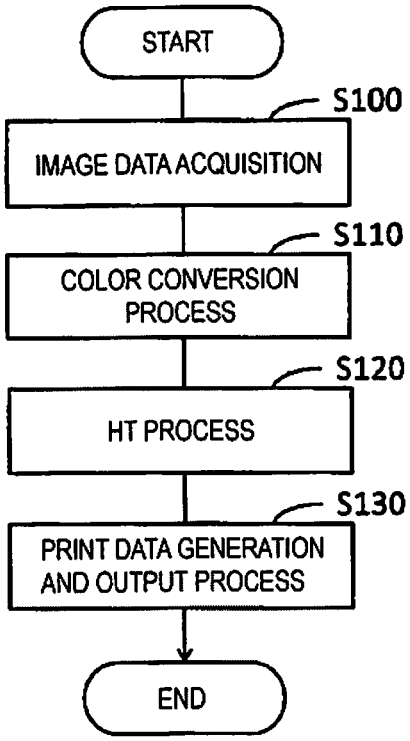
FIG. 3 is a flowchart illustrating a process executed by a control unit in accordance with program A.

FIG. 3 is a flowchart illustrating the print control process executed by the control unit 11 in accordance with program A.

The control unit 11 (image data acquiring unit 12) acquires image data that expresses a print target (step S100). The print target is, for example, a text, an image, a computer graphic (CG), or a combination of these. For example, a user selects image data by operating the operation receiving unit 17. The image data acquiring unit 12 acquires the selected image data from a storage source. Examples of the storage source of the image data are various, including a storage medium built into the printing control apparatus 10, a storage medium externally coupled to the printing control apparatus 10, and the like. The image data acquiring unit 12 delivers the acquired image data to the next step S110.

The image data delivered by the image data acquiring unit 12 to step S110 is, for example, red, green, and blue (RGB) data of a bitmap format that includes a gradation value (a gradation value expressed by 256 gradations of 0 to 255, for example) for each RGB per pixel. The image data acquiring unit 12 executes format conversion and resolution conversion on the acquired image data before delivering the image data to step S110.

In step S110, the control unit 11 (color converting unit 13) executes a color conversion process on the image data. The color conversion process is a process of converting image data (RGB data) into data (CMYK data) of an ink color space used for printing by the printing unit 20. As is known, the color converting unit 13 is configured to execute the color conversion process while referring to a table (color conversion look-up table) in which the gradation values of the RGB data are associated with the gradation values of the CMYK data. The image data (CMYK data) after the color conversion process is data of a bitmap format that includes a gradation value (a gradation value expressed by the 256 gradations of 0 to 255, for example) for each CMYK per pixel.

In step S120, the control unit 11 (HT processing unit 14) executes the HT process for each ink color (CMYK) on the image data after color conversion processing. The HT process converts data indicating 256 gradations into 1-bit data indicating 2 gradations or 2-bit data indicating 4 gradations, for example. The HT process can be executed using a dither method, a γ correction method, an error diffusion method, and the like. The image data after the HT process is referred to as HT data. The HT data is the data per ink color for driving the nozzle groups corresponding to each ink color, and specifies the presence or absence of dots per pixel.

In the first embodiment, the HT processing unit 14 generates first HT data for driving the first nozzle group corresponding to ink of the same color, and second HT data for driving the second nozzle group corresponding to ink of the same color, in an uncorrelated manner. As an example of a process for such generation in an uncorrelated manner can be achieved by independently generating the first HT data and the second HT data. Details of the step S120 will be described later.

In step S130, the control unit 11 (print data generating unit 15) generates print data used for printing by the printing unit 20 based on the HT data generated in step S120, and outputs the generated print data to the printing unit 20. That is, the print data generating unit 15 sorts the pixels aligned in a matrix constituting the HT data into the order in which the data is to be transferred to the printing unit 20. Such sorting is referred to as a rasterization process, and rasterized HT data is referred to as print data. Such a rasterization process determines which pixel data is to be assigned to which nozzle 27 of the nozzle group.

The print data generating unit 15 outputs (transfers) print data generated by the rasterization process to the printing unit 20 via the communication IF 18. Based on the print data output in this manner, the printing unit 20 drives each of the nozzles 27 and executes printing based on the data of the pixels assigned to each of the nozzles 27. As a result, the print target expressed by the image data acquired in step S100 is reproduced on the printing medium P.

3. Details of HT Process and Printing (First Embodiment)

Figure 4:
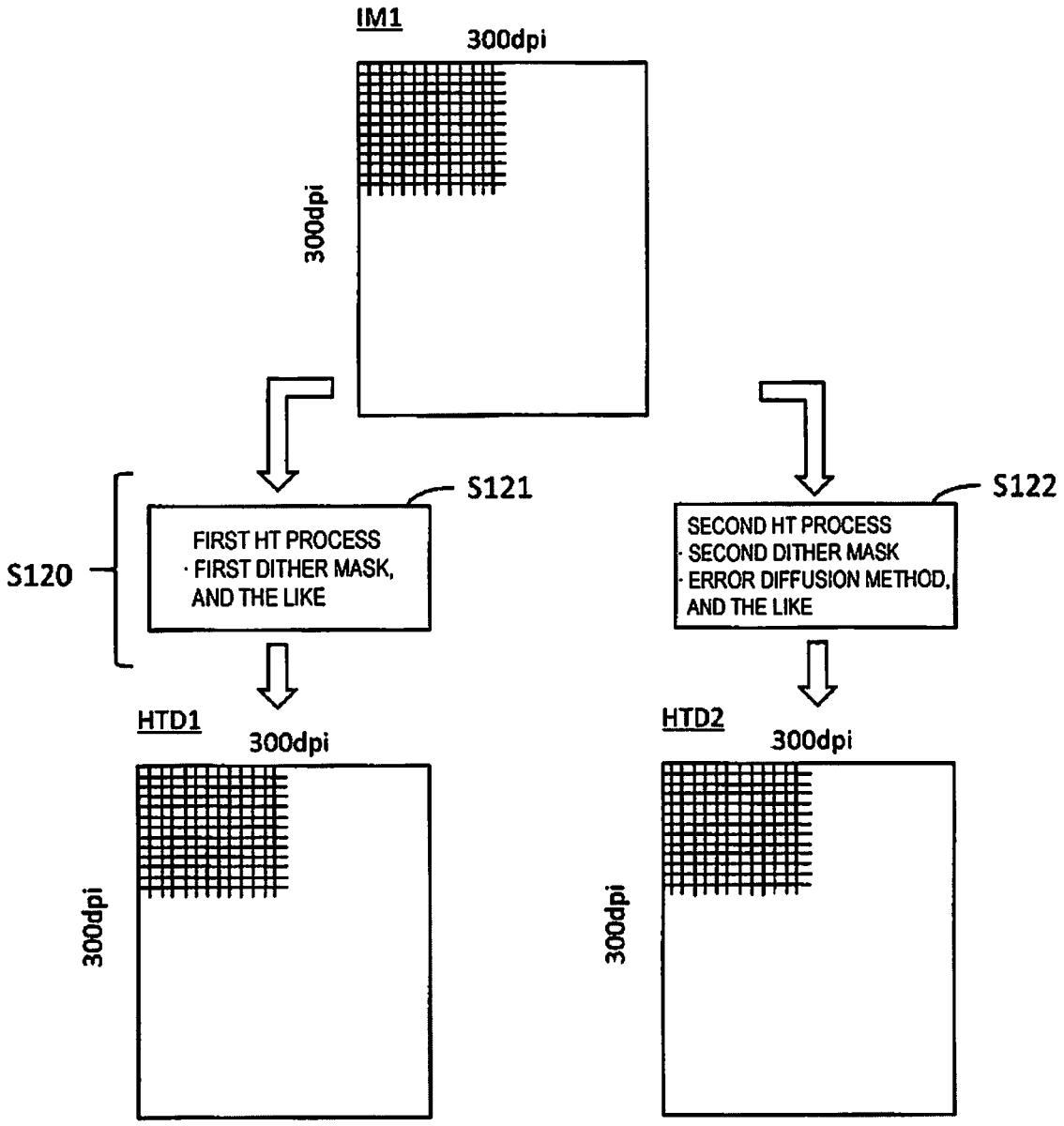
FIG. 4 is a diagram for explaining step S120 (HT process).

FIG. 4 is a diagram for explaining an example of the HT process executed by the HT processing unit 14 in step S120. Image data IM1 indicates image data subject to the HT process of step S120, that is, image data after the color conversion process. The image data IM1 is, for example, an image having vertical and horizontal resolutions (dpi: dots per inch) of 300 dpi. The vertical direction of the image data IM1 corresponds to the transport direction D2 during printing by the print head 21, and the horizontal direction of the image data IM1 corresponds to the main scanning direction D1 during printing by the print head 21. Further, the nozzle resolution npi in the nozzle alignment direction (transport direction D2) of the nozzle group unit of the print head 21 is 300 npi as described above. That is, by the completion of step S110, the control unit 11 generates the image data IM1 in which the resolution in the vertical direction is equivalent to the nozzle resolution in the nozzle alignment direction of the nozzle group unit, and the resolution in the horizontal direction is equivalent to the print resolution in the main scanning direction D1 by the print head 21.

In step S120, the HT processing unit 14 executes a first HT process on the image data IM1 (step S121) to generate first HT data (HTD1) for driving the first nozzle group, and executes a second HT process on the image data IM1 (step S122) to generate second HT data (HTD2) for driving the second nozzle group. The HTD1 and the HTD2 are (uncorrelated) HT data having no correlation. Further, the HTD1 and the HTD2, similar to the image data IM1, each have vertical and horizontal resolutions of 300 dpi.

For example, the HT processing unit 14 generates the HTD1 by the dither method by applying a first dither mask generated in advance and stored in the RAM 11*c* and the like to the image data IM1 (step S121). Further, the HT processing unit 14 generates the HTD2 by the dither method by applying a second dither mask generated in advance in a manner unrelated to the first dither mask and stored in the RAM 11*c* and the like to the image data IM1 (step S122). As is known, the dither mask is a mask provided in a matrix with threshold values (threshold values of levels 0 to 255, for example) for determining an ON (present) or OFF (absent) status of a dot per pixel in the image data of the application target. In a single dither mask, the threshold values are appropriately disposed in advance taking into consideration a dispersibility and the like of the dots to be generated. With the arrangement of such threshold values determined in an unrelated manner, the first HT process (step 121) and the second HT process (step S122) based on the first dither mask and the second dither mask, respectively, are performed, making it possible to generate the HTD1, HTD2, which are uncorrelated.

Alternatively, the HT processing unit 14 may generate the HTD1 by the dither method by applying a dither mask (the first dither mask, for example) generated in advance and stored in the RAM 11*c* and the like to the image data IM1 (step S121), and generate the HTD2 by applying the error diffusion method to the image data IM1 (step S122). That is, the uncorrelated HTD1, HTD2 are generated by executing completely different processes such as the dither method and the error diffusion method on the image data IM1, respectively.

Alternatively, the HT processing unit 14 generates the HTD1 by the dither method by applying a dither mask (the first dither mask, for example) generated in advance and stored in the RAM 11*c* and the like to the image data IM1 (step S121). Further, the HT processing unit 14 may generate the HTD2 by the dither method by applying the dither mask used to generate the HTD1 to the image data IM1 in a positional relationship displaced from the positional relationship between the dither mask and the image data IM1 when the dither mask was applied to the image data IM1 in generation of the HTD1 (step S122). That is, the same dither mask is applied to the image data IM1 in steps S121, S122 while the application positions (application start positions) of the dither mask with respect to the image data IM1 are caused to be displaced from each other in steps S121, S122, consequently making it possible to generate two sets of uncorrelated HTD (HTD1, HTD2).

Needless to say, each pixel of the image data IM1 includes a gradation value for each ink color (CMYK). Thus, the HT processing unit 14 executes steps S121, S122 for each ink color, and generates the HTD1, HTD2 for each ink color.

Then, in step S130, the print data generating unit 15 executes the rasterization process on the HTD1, HTD2 for each ink color generated in step S120 (S121, S122), assigns the HTD1 (print data) after the rasterization process for each ink color to the first nozzle group of each ink color, outputting the HTD1 to the printing unit 20, and assigns the HTD2 (print data) after the rasterization process for each ink color to the second nozzle group of each ink color, outputting the HTD2 to the printing unit 20.

As a result, the nozzles 27 of the nozzle group 23C (first nozzle group) corresponding to the C ink are each driven (controlled in terms of dot ejection and non-ejection) by the HTD1 of the C ink, and the nozzles 27 of the nozzle group 26C (second nozzle group) corresponding to the C ink are each driven by the HTD2 of the C ink. Similarly, the nozzles 27 of the nozzle group 23Y (first nozzle group) corresponding to the Y ink are each driven by the HTD1 of the Y ink, and the nozzles 27 of the nozzle group 26Y (second nozzle group) corresponding to the Y ink are each driven by the HTD2 of the Y ink. Similarly, the nozzles 27 of the nozzle group 24M (first nozzle group) corresponding to the M ink are each driven by the HTD1 of the M ink, and the nozzles 27 of the nozzle group 25M (second nozzle group) corresponding to the M ink are each driven by the HTD2 of the M ink. Similarly, the nozzles 27 of the nozzle group 24K (first nozzle group) corresponding to the K ink are each driven by the HTD1 of the K ink, and the nozzles 27 of the nozzle group 25K (second nozzle group) corresponding to the K ink are each driven by the HTD2 of the K ink.

Here, as understood from the description related to FIG. 2, the nozzles 27 of the first nozzle group and the second nozzle group corresponding to ink of the same color are alternately aligned at a spacing of N/2 (ideally) along the nozzle alignment direction (transport direction D2), respectively. Further, in the example described above, the nozzle resolution in the nozzle alignment direction of a single nozzle group is 300 npi. Thus, each raster where the nozzles 27 of the first nozzle group (the nozzle group 23C, for example) print on the printing medium P in accordance with the HTD1, and each raster where the nozzles 27 of the second nozzle group (nozzle group 26C) print on the printing medium P in accordance with the HTD2 are ideally aligned at equal spacing (a spacing of N/2) along the transport direction D2, and a print result having a print resolution of 600 dpi in the transport direction D2 (and 300 dpi in the main scanning direction D1) overall is obtained. The term "raster" refers to one pixel row of pixels aligned along the main scanning direction D1, or the print result of the one pixel row.

However, when an error between nozzle groups exists in the arrangement of the first nozzle group and the second nozzle group corresponding to ink of the same color, each raster where the nozzles 27 of the first nozzle group print in accordance with the HTD1 and each raster where the nozzles 27 of the second nozzle group print in accordance with the HTD2 partially overlap and the like, and thus, the ideal print result of a print resolution of 600 dpi in the transport direction D2 cannot be obtained.

Figure 5:
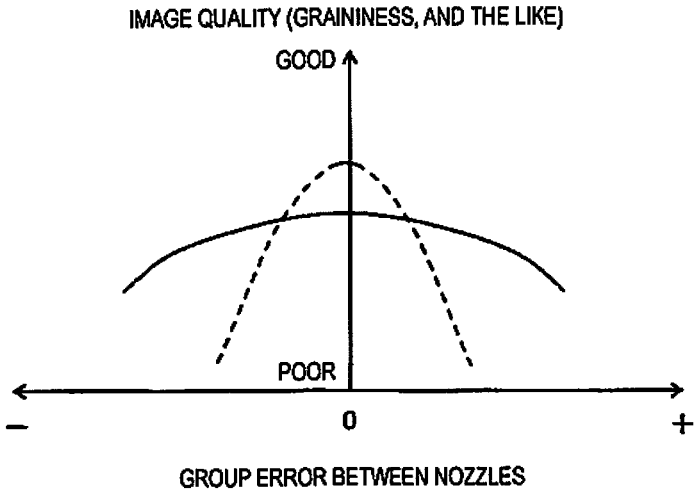
FIG. 5 is a graph for comparing and explaining image qualities of print results from the first embodiment and a conventional technique.

FIG. 5 is a graph for comparing and explaining the image quality of the print result of the first embodiment (solid line) and the image quality of the print result of a conventional technique (dashed line). In FIG. 5, the horizontal axis indicates the degree of the error between nozzle groups, and the vertical axis indicates the degree of image quality (graininess and unevenness, for example) of the print result. The horizontal axis uses the ideal arrangement for the relationship between the first nozzle group and the second nozzle group corresponding to ink of the same color as reference (error between nozzle groups=0). Then, when the ideal arrangement is set as reference, the displacement amount when the second nozzle group is displaced downstream in the transport direction D2 is a positive error, and the displacement amount when the second nozzle group displaced upstream in the transport direction D2 is a negative error, for example. On the other hand, the image quality of the vertical axis is an image quality index value for the graininess and unevenness (striation-like unevenness which is called banding, for example) of the print result calculated by a known evaluation method, and is calculated based on color measurement and observations of the print result by the first nozzle group and the second nozzle group.

Conventionally, the first nozzle group and the second nozzle group corresponding to ink of the same color have been regarded as a single nozzle group (one as a whole), and image processing for driving such a single nozzle group as a whole (a nozzle group that is supposed to have an ideal nozzle resolution (600 npi) in the transport direction D2) was performed. Conventionally, compared to the specific example given in the first embodiment, image data (CMYK data) having a vertical×horizontal resolution of 600 dpi×300 dpi was generated and, for example, an HT process was executed on this image data by applying a predetermined dither mask. Thus, conventionally, the overall image printed by the first nozzle group and the second nozzle group corresponding to ink of the same color was converted to HT data having a dot distribution with a certain correlation resulting from the single HT process, and the first nozzle group and the second nozzle group were each driven based on this HT data.

If the first nozzle group and the second nozzle group corresponding to ink of the same color have an ideal arrangement, the conventional technique achieves excellent quality. That is, the overall image printed by the first nozzle group and the second nozzle group achieves the image quality (an image quality obtained by considering the dispersibility of dots and the like) to be achieved by the HT process that uses a single dither mask and the like on the printing medium P, and thus, a favorable print result with high graininess and minimal unevenness is obtained. However, the conventional technique is based on the premise that the first nozzle group and the second nozzle group corresponding to ink of the same color are in an ideal arrangement. Thus, when an error between nozzle groups exists, the image quality to be achieved by the HT process tends to fail on the printing medium P because of the partial overlapping and the like of the rasters. That is, in such a conventional technique, there is a significant difference in the achievable print quality between a case in which there is an error between nozzle groups and a case in which there is no error between nozzle groups in the first nozzle group and the second nozzle group corresponding to ink of the same color (refer to the dashed line in FIG. 5). As described above, because reducing the error between nozzle groups to 0 in the entire print heads 21 to be mass produced is unrealistic, it is difficult to make the print quality between products (the print head 21 and the printing unit 20) uniform using known techniques.

Here, in the first embodiment, the HT processing unit 14 generates the first HT data (HTD1) for driving the first nozzle group corresponding to ink of the same color, and the second HT data (HTD2) for driving the second nozzle group corresponding to ink of the same color in an uncorrelated manner to stabilize the print quality. According to the first embodiment, there is no correlation between the HTD1 and the HTD2. That is, the distribution of dots in the HTD1 and the distribution of dots in the HTD2 are determined in an unrelated manner. Thus, when there is an error between nozzle groups of the first nozzle group and the second nozzle group corresponding to ink of the same color, the image quality of the overall image printed by the first nozzle group and the second nozzle group is somewhat inferior compared to the image quality of conventional techniques. On the other hand, even when there is an error between nozzle groups of the first nozzle group and the second nozzle group corresponding to ink of the same color, displacement occurs in the positional relationship between the uncorrelated dot distributions, and thus, there is substantially no change (deterioration) in the image quality of the overall image printed by the first nozzle group and the second nozzle group. That is, according to the first embodiment, there is minimal difference between a case in which there is an error between nozzle groups and a case in which there is no error between nozzle groups in the first nozzle group and the second nozzle group corresponding to ink of the same color (refer to the solid line in FIG. 5). In this way, the print quality can be stabilized, that is, the print quality between products can be made uniform.

4. Second Embodiment

The embodiment described above is called the first embodiment. Next, a second embodiment will be described. In the second embodiment (and a third embodiment described later), elements that differ from the elements of the first embodiment are mainly described.

In step S120 of the second embodiment (FIGS. 3 and 4), the HT processing unit 14 executes the first HT process on the image data IM1 (step S121) and the second HT process on the image data IM1 (step S122) to generate the HTD1 for driving the first nozzle group and the HTD2 for driving the second nozzle group in an uncorrelated manner. At this time, the HT processing unit 14 generates the HTD1 and the HTD2 that drive only one of the first nozzle group and the second nozzle group corresponding to an image having a brightness of a predetermined highlight range in the image data IM1.

For example, the first dither mask applied to the image data IM1 in the first HT process (step S121) by the HT processing unit 14 is a dither mask having only threshold values greater than the threshold value corresponding to the upper limit of the predetermined highlight range within the range of gradation values (0 to 255) for each CMYK of each pixel of the image data IM1. As an example, when a range from 0 to 30% of an ink concentration among 0 to 100% of the printing medium P is defined as the highlight range, the gradation value corresponding to the upper limit (30%) of the highlight range (the gradation value corresponding to 30% when 0 to 100% is standardized to the gradation range of 0 to 255) is 76, and this value of 76 is the threshold value. Thus, the first dither mask is the dither mask having threshold values (from 77 to 255) greater than the threshold value (76, for example) corresponding to the upper limit of the highlight range. On the other hand, the second dither mask applied to the image data IM1 in the second HT process (step S122) by the HT processing unit 14 is a dither mask that also has threshold values less than or equal to the threshold value corresponding to the upper limit of the highlight range.

Figure 6:
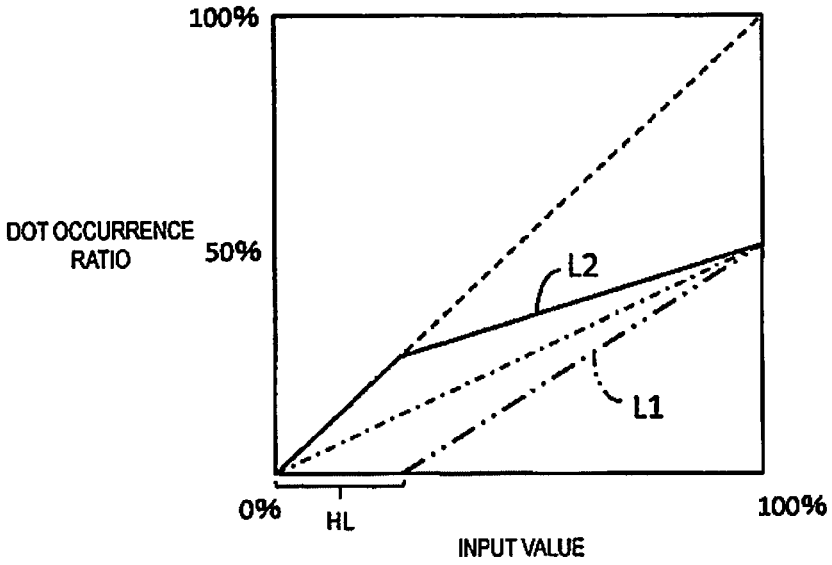
FIG. 6 is a graph illustrating a change in a dot occurrence ratio by each of a first dither mask and a second dither mask used in a second embodiment.

FIG. 6 is a graph illustrating a change in a dot occurrence ratio corresponding to input values by each of the first dither mask and the second dither mask used in the second embodiment. The input values illustrated on the horizontal axis in FIG. 6 express the gradation range (0 to 255) that can be achieved by the gradation value of one ink color per pixel of the image data IM1 in terms of a concentration of 0 to 100%. The concentration and the brightness have a relationship such that the brightness decreases as the concentration increases and the brightness increases as the concentration decreases. The dot occurrence ratio indicated on the vertical axis in FIG. 6 indicates the ratio of dot ON pixels to the number of pixels constituting an image obtained by combining the HTD1 and the HTD2, that is, an image printed by the first nozzle group and the second nozzle group corresponding to ink of the same color (vertical×horizontal=600 dpi×300 dpi). In the description of FIG. 6, it is presumed for the sake of convenience that the entire pixels constituting the image data IM1 have the same gradation value (concentration). In this case, as indicated by the dashed line (slope=1) in FIG. 6, the dot occurrence ratio increases from 0 to 100% as the input value rises from 0 to 100%. The dot occurrence ratio of 50% in FIG. 6 corresponds to the number of dots when the entire nozzles 27 of one nozzle group are driven and dots are formed in the entire pixels of an image that can be printed by the one nozzle group (vertical×horizontal=300 dpi×300 dpi).

Generally, a dither mask increases the number of produced dots in proportion to the rise of the input value. Thus, normally, the first dither mask and the second dither mask increase the number of dots produced in proportion to the rise of the input value in the same way (an increase in the dot occurrence ratio from 0 to 50%; refer to the dashed line in FIG. 6). However, in the second embodiment, the first dither mask achieves a dot occurrence ratio such as indicated by the graph L1 (two-dot chain line) in FIG. 6, and the second dither mask achieves a dot occurrence ratio such as indicated by the graph L2 (solid line) in FIG. 6.

The graph L1 keeps the number of produced dots at 0% for the input values within the highlight range (HL) described above. Furthermore, for the input values that exceed the highlight range HL, the graph L1 increases the number of produced dots from 0 to 50% (highest) in accordance with the rise of the input value.

On the other hand, the graph L2 increases the dot occurrence ratio at the same rate of increase as the graph of the dashed line having a slope of 1 in accordance with the rise of the input value for the input values within the highlight range (HL). Furthermore, for the input values that exceed the highlight range HL, the graph L2 increases the number of produced dots to 50% (highest) in accordance with the rise of the input value at a rate of increase lower than the rate of increase of the graph L1 for the input values that exceed the highlight range HL.

In other words, the first dither mask is a mask in which the threshold values (the threshold values (from 77 to 255, for example) greater than the threshold value corresponding to the upper limit of the highlight range) are arranged in a matrix to increase the number of produced dots according to the mode indicated by the graph L1 in accordance with the increase in input value (gradation value of the image data IM1 of the application target). Further, the second dither mask is a mask in which the threshold values (from 0 to 255) are arranged in a matrix to increase the number of produced dots according to the mode indicated by the graph L2 in accordance with the increase in input value (gradation value of the image data IM1 of the application target).

The HTD1 generated by the first HT process (step S121) by applying such a first dither mask to the image data IM1 is HT data which does not produce dots for pixels that, among the pixels constituting the image data IM1, have a brightness (gradation value) within the highlight range. On the other hand, the HTD2 generated by the second HT process (step S122) by applying the second dither mask to the image data IM1 is HT data which can produce dots for pixels that, among the pixels constituting the image data IM1, have a brightness (gradation value) within the highlight range.

Alternatively, the HT processing unit 14 may apply the dither mask (first dither mask) having the threshold values greater than the threshold value corresponding to the upper limit of the highlight range such as described above to the image data IM1 in the first HT process (step S121) to generate the HTD1, while applying an error diffusion method to the image data IM1 in the second HT process (step S122) to generate the HTD2. At this time, in the error diffusion method, dots can be produced for pixels that, among the pixels constituting the image data IM1, have a brightness (gradation value) within the highlight range.

Thus, in step S130 of the second embodiment, as a result of the print data being output to the printing unit 20 based on such HTD1, HTD2, an image in which the brightness of the image data IM1 is within the highlight range (an image portion that expresses a bright space, for example) is printed only by the ink ejection from the second nozzle group driven in accordance with the HTD2 (print data) and not by the first nozzle group driven in accordance with the HTD1 (print data).

According to the second embodiment, the advantages such as described below are achieved in addition to the advantages described in the first embodiment. Particularly in the highlight portion of an image, the dots are sparse and thus a user easily recognizes and becomes sensitive to the granular quality of the dots. Thus, in a print result having low graininess, deterioration in such graininess is visible particularly in the highlight portion. From the viewpoint of the actual circumstances in which an error between nozzle groups of the first nozzle group and the second nozzle group corresponding to the ink of the same color may occur, deterioration in the graininess caused by the error between nozzle groups (refer to solid line of FIG. 5) stands out more in the highlight portion of the image. According to the second embodiment, the printing of such a highlight portion uses only one of the first nozzle group and the second nozzle group corresponding to ink of the same color. In this way, deterioration in graininess caused by the error between nozzle groups in the highlight portion can be eliminated, making it possible to further improve the image quality.

Moreover, as a technique of the HT process, an error diffusion method readily achieves an image quality having high dot dispersibility and high graininess (a granular quality that is smooth and does not stand out) compared to the dither method. Thus, while the dither mask (first dither mask) having the threshold values greater than the threshold value corresponding to the upper limit of the highlight range such as described above is applied to the image data IM1 to generate the HTD1 (step S121), the error diffusion method is applied to the image data IM1 to generate the HTD2 (step S122). In this manner, only one of the first nozzle group and the second nozzle group (the second nozzle group in this case) is used in the printing of the highlight portion, making it possible to further improve the image quality of the highlight portion.

5. Third Embodiment

The print head 21 of the printing unit 20 may be configured to eject a plurality of sizes of dots having different volumes of liquid per droplet. For example, the print head 21 is configured to eject three types of dots of different sizes (large dots, medium dots, and small dots) from the nozzles 27. The volume per dot droplet of each different size is determined in advance by the design of the printing unit 20. Thus, the HT data (first HT data, second HT data) of each ink color generated by the HT processing unit 14 in step S120 is data that specifies whether the dot is ON (present) or OFF (absent) and, in a case where the dot is ON, whether the dot is a large dot, medium dot, or small dot.

Figure 7:
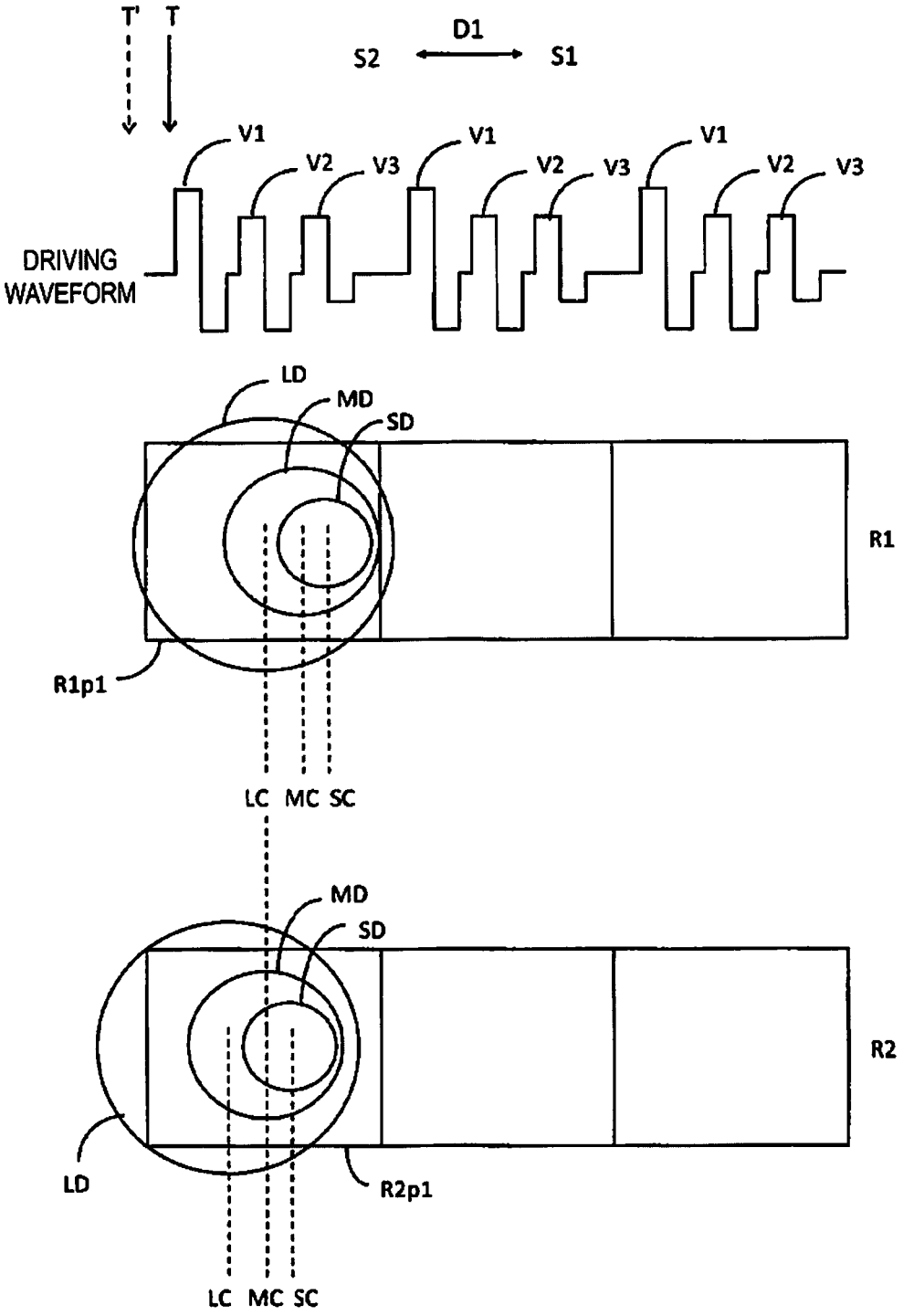
FIG. 7 is a diagram illustrating a relationship between a driving waveform of a nozzle and dots.

FIG. 7 is a simplified diagram illustrating an example of the relationship between the driving waveform applied to one of the nozzles 27 (an actuator of the nozzle 27) of the print head 21, and the dots ejected and formed on the printing medium P by the one of the nozzles 27 in accordance with the driving waveform. The reference signs LD, MD, and SD denote large dots, medium dots, and small dots, respectively. In the description of FIG. 7, the print head 21 is presumed to be executing a pass moving toward, among a first side S1 and a second side S2 in the main scanning direction D1, the first side S1.

As is known, the print head 21 includes an actuator based on a piezoelectric element and the like in each nozzle 27, and a driving waveform (pulse) is applied to the actuator based on print data to cause the dots to be ejected from the nozzle 27 corresponding to the actuator. Such a driving waveform is also referred to as a common waveform, a common voltage, and the like. In the example illustrated in FIG. 7, the driving waveform as a whole corresponding to the recording period of one pixel in the middle of a pass is configured by waveforms V1, V2, V3. In this example, when the entire waveforms V1, V2, V3 constituting the driving waveform are applied to the actuator, the droplets ejected in sequence from the one nozzle 27 in accordance with each of the waveforms V1, V2, V3 join together and form one dot (large dot LD) upon landing on the printing medium P.

Further, when the waveforms V2, V3 among the waveforms V1, V2, V3 constituting the driving waveform are applied to the actuator, the droplets ejected in sequence from the one nozzle 27 in accordance with each of the waveforms V2, V3 join together and form one dot (medium dot MD) upon landing on the printing medium P. Further, when the waveform V3 among the waveforms V1, V2, V3 constituting the driving waveform is applied to the actuator, the droplet ejected from the one nozzle 27 in accordance with the waveforms V3 lands on the printing medium P, forming a dot (small dot SD). That is, when the data of large dot ON is assigned to the one nozzle 27, the printing unit 20 applies the waveforms V1, V2, V3 as the driving waveform to the actuator of the nozzle 27 to form the large dot LD. Similarly, when the data of medium dot ON is assigned to the one nozzle 27, the waveforms V2, V3 are applied but the waveform V1 is not applied to the actuator of the nozzle 27 to form the medium dot MD, and when the data of small dot ON is assigned to the one nozzle 27, the waveform V3 is applied but the waveforms V1, V2 are not applied to the actuator of the nozzle 27 to form the small dot SD.

The reference sign R1 in FIG. 7 denotes a position of a raster (raster position) on the printing medium P that is expected to be printed by a certain nozzle 27 (one nozzle which belongs to the first nozzle group, for example). Further, each rectangle constituting the raster position R1 illustrates an individual pixel position (pixel position R1*p*1, for example) constituting the raster expected to be printed by the nozzle 27. This does not mean that such a raster position and pixel position are drawn on the printing medium P.

According to the driving waveform illustrated in FIG. 7, a timing of occurrence of each of the waveforms V1, V2, V3 within a minute period corresponding to the recording time of one pixel is determined without dependency on whether the waveforms 1, V2, V3 are actually applied or not applied to the actuator. Thus, mutual displacement may occur in the positions (in the main scanning direction D1) of the large dot LD, medium dot MD, and small dot SD formed for one pixel. That is, as illustrated in FIG. 7, deviation occurs between a center position LC of a large dot LD when the large dot LD is formed in one pixel position R1*p*1 of the raster position R1, a center position MC of a medium dot MD when the medium dot MD is formed in the pixel position R1*p*1, and a center position SC of a small dot SD when the small dot SD is formed in the pixel position R1*p*1.

The timing of occurrence of the driving waveform is adjustable by adjusting the occurrence timing of the first waveform V1 of the first driving waveform for printing one raster. Further, such adjustment of the occurrence timing can be executed per pass and per nozzle group. The reference sign R2 in FIG. 7 denotes a position of a raster (raster position) on the printing medium P that is expected to be printed by a certain nozzle 27 (one nozzle which belongs to the second nozzle group). Further, among the pixel positions constituting the raster position R2, the pixel position R2*p*1 is in the same position in the main scanning direction D1 as the pixel position R1*p*1 of the raster position R1. Thus, to ensure that the positions of the dot formed in the pixel position R1*p*1 by the nozzle 27 of the first nozzle group and the dot formed in the pixel position R2*p*1 by the nozzle 27 of the second nozzle group coincide in the main scanning direction D1, the occurrence timing of the driving waveform applied to the nozzle 27 of the first nozzle group and the occurrence timing of the driving waveform applied to the nozzle 27 of the second nozzle group are adjusted.

For example, the nozzle group 23C serving as the first nozzle group and the nozzle group 26C serving as the second nozzle group corresponding to the C ink are disposed to be a predetermined distance apart in the main scanning direction D1 by the design of the print head 21 (refer to FIG. 2). Here, normally the occurrence timing of the driving waveform applied to the nozzles 27 of the second nozzle group (nozzle group 26C) in a certain pass (the pass of movement toward the first side S1 in the main scanning direction D1) delayed by the amount of time required by the print head 21 to move the predetermined distance is the occurrence timing of the driving waveform applied to the nozzles 27 of the first nozzle group (nozzle group 23C). In this way, within the pass, the positions of the dot formed in the pixel position R2*p*1 by the nozzle 27 of the second nozzle group (nozzle group 26C) and the dot formed in the pixel position R1*p*1 by the nozzle 27 of the first nozzle group (nozzle group 23C) theoretically coincide in the main scanning direction D1.

However, such an adjustment of the occurrence timing of the driving waveform does not take into consideration the displacement (deviation between the center positions LC, MC, SC) in the main scanning direction D1 between dots of different sizes. In the third embodiment, in order to readily suppress such a displacement in the main scanning direction D1 between dots of different sizes the HT processing unit 14 generates one of the first HT data and the second HT data as HT data specifying the presence and absence of first size dots, and generates the other as HT data specifying the presence and absence of second size dots smaller than the first size dots in step S120 (FIG. 3). Here, the large dot LD is the first size dot, and the medium dot MD and the small dot SD are the second size dots. However, the large dot LD and the medium dot MD may be the first size dots, and the small dot SD may be the second size dot.

Figure 8:
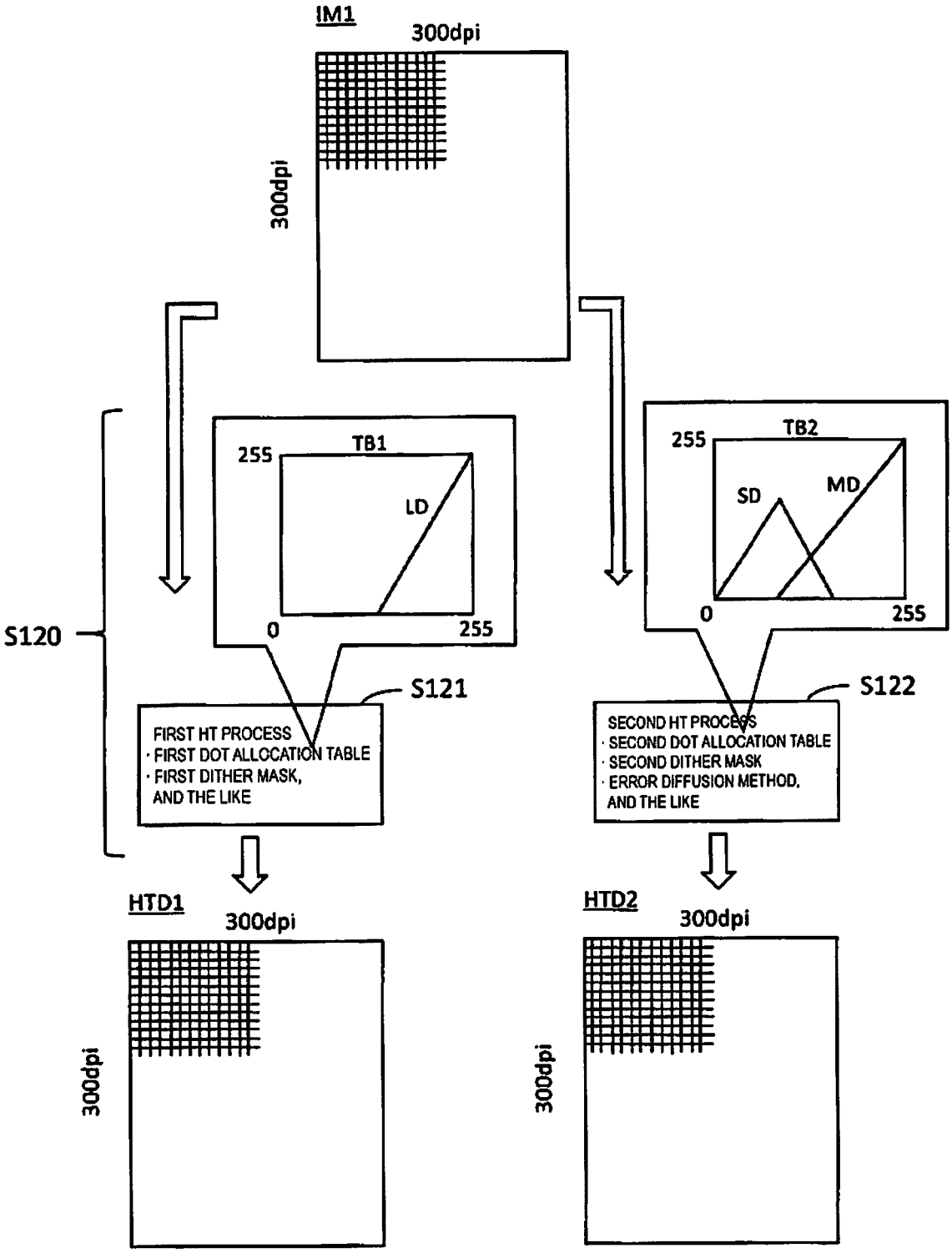
FIG. 8 is a diagram for explaining step S120 (HT process) of a third embodiment.

FIG. 8 is a diagram for explaining an example of the HT process executed by the HT processing unit 14 in step S120 of the third embodiment. FIG. 8 is viewed in the same manner as FIG. 4. In step S120 of the third embodiment, the HT processing unit 14 also executes the first HT process (step S121) on the image data IM1 and the second HT process (step S122) on the image data IM1 to generate the HTD1 for driving the first nozzle groups and the HTD2 for driving the second nozzle group in an uncorrelated manner.

The HT processing unit 14 converts the gradation value of each pixel of the image data IM1 by inputting the value into a dot allocation table in the first HT process (step S121) and the second HT process (step S122), respectively. The dot allocation table is a table that converts input gradation values (the 256 gradations of 0 to 255, for example) to recording rates (output gradation values) for each dot of a different size. In the third embodiment, a first dot allocation table TB1 generated in advance is used for conversion in the first HT process (step S121), and a second dot allocation table TB2 generated in advance is used for conversion in the second HT process (step S122).

In FIG. 8, although illustrated in a simplified manner, the first dot allocation table TB1 is a table for converting an input gradation value to a recording rate (output gradation value) of a large dot LD, and the second dot allocation table TB2 is a table for converting an input gradation value to a recording rates (output gradation value) of a small dot SD or a medium dot MD. The HT processing unit 14, in the first HT process (step S121), performs, for example, the HT process by the dither method using the first dither mask on an output gradation value after conversion based on the first dot allocation table TB1 to generate the HTD1 specifying dot OFF or large dot LD ON for each pixel. On the other hand, the HT processing unit 14, in the second HT process (step S122), performs, for example, the HT process by the dither method using the second dither mask and the HT process by an error diffusion method on an output gradation value after conversion based on the second dot allocation table TB2 to generate the HTD2 specifying dot OFF or small dot SD ON or medium dot MD ON for each pixel.

Thus, in step S130 of the third embodiment, as a result of the print data being output to the printing unit 20 based on such HTD1, HTD2, only a large dot LD is ejected by the nozzles 27 of the first nozzle group driven in accordance with the HTD1 (print data), and only a medium dot MD or a small dot SD is ejected from the nozzles 27 of the second nozzle group driven in accordance with the HTD2 (print data). Further, in the third embodiment, the control unit 11 (print data generating unit 15) notifies the printing unit 20 of a "displacement adjustment value" for correcting displacement between dots of different sizes in the main scanning direction D1, which is determined by pretesting and the like, along with print data.

The displacement adjustment value is described below. The control unit 11 repeatedly executes test printing that forms dots of different sizes in the same pixel positions (pixel positions in the same position in the main scanning direction D1) on the printing medium by the first nozzle group (nozzle group 23C) and the second nozzle group (nozzle group 26C) corresponding to the C ink while making various minor adjustments in the occurrence timing of the driving waveform applied to the nozzles 27 of the nozzle group 26C and in the occurrence timing of the driving waveform applied to the nozzles 27 of the nozzle group 23C, for example. Naturally, at this time, with the occurrence timing of the driving waveform corresponding to the distance (predetermined distance) between the nozzle group 26C and the nozzle group 23C in the main scanning direction D1 such as described above being adjusted (basically adjusted), an even more detailed adjustment value, that is, the displacement adjustment value, of the occurrence timing of the driving waveform applied to the nozzles 27 of the nozzle groups 23C, 26C is determined, respectively.

More specifically, as illustrated in FIG. 7, the control unit 11 determines, as the displacement adjustment value, the adjustment value of the period when the center position LC of the large dot LD formed in the pixel position R1*p*1 of the raster position R1 by the nozzles 27 of the first nozzle group (nozzle group 23C) and center position MC of the medium dot MD formed in the pixel position R2*p*1 of the raster position R2 by the nozzles 27 of the second nozzle group (nozzle group 26C) coincide in the main scanning direction D1. A timing T illustrated in FIG. 7 is, for example, the occurrence timing of the driving waveform relative to the pixel position R1*p*1 for forming the large dot LD in the pixel position R1*p*1 of the raster position R1 by the nozzles 27 of the first nozzle group (nozzle group 23C). In contrast, a timing T' illustrated in FIG. 7 is the occurrence timing of the driving waveform relative to the pixel position R2*p*1 for forming the medium dot MD in the pixel position R2*p*1 of the raster position R2 by the nozzles 27 of the second nozzle group (nozzle group 26C), and indicates the occurrence timing of the driving waveform when the center position LC of the large dot LD formed in the pixel position R1*p*1 and the center position MC of the medium dot MD coincide in the main scanning direction D1. That is, the time difference corresponding to the basic adjustment is further adjusted by the difference between the timing T and the timing T' (the displacement adjustment value).

The control unit 11 (print data generating unit 15) notifies the printing unit 20 of such a displacement adjustment value determined in advance along with print data. In this way, adjustment of the occurrence timing of the driving waveform for the first nozzle group and the occurrence timing of the driving waveform for the second nozzle group in a pass by the print head 21 is executed in accordance with the displacement adjustment value along with the basic adjustment. As a result, as illustrated in FIG. 7, the center position MC of the medium dot MD (second size dot) formed in the pixel position R2*p*1 of the raster position R2 by the nozzles 27 of the second nozzle group (nozzle group 26C) and the center position LC of the large dot LD formed (first size dot) in the pixel position R1*p*1 of the raster position R1 by the nozzles 27 of the first nozzle group (nozzle group 23C) coincide in the main scanning direction D1.

With the basic adjustment alone, when the small dot SD is formed in the pixel position R2*p*1 of the raster position R2 by the nozzles 27 of the second nozzle group (nozzle group 26C) and the large dot LD is formed in the pixel position R1*p*1 of the raster position R1 by the nozzles 27 of the first nozzle group (nozzle group 23C), for example, displacement in an amount corresponding to a difference between the center positions LC−MC plus a difference between the center positions MC−SC occurs in the main scanning direction D1 between the large dot LD and the small dot SD. Further, when the small dot SD is formed in the pixel position R2*p*1 of the raster position R2 by the nozzles 27 of the second nozzle group (nozzle group 26C) and when the large dot LD is formed in the pixel position R2*p*1 by the nozzles 27 of the second nozzle group (nozzle group 26C), for example, displacement in an amount corresponding to the difference between the center positions LC−MC plus the difference between the center positions MC−SC occurs in the main scanning direction D1 regardless of the position being the same pixel position R2*p*1.

On the other hand, according to the third embodiment, the first nozzle group (nozzle group 23C) forms only the first size dot (large dot LD) and the second nozzle group (nozzle group 26C) forms only the second size dots (medium dot MD and small dot SD), and adjustment by the displacement adjustment value is added to the basic adjustment as described above. In this way, when the small dot SD is formed in the pixel position R2*p*1 of the raster position R2 by the nozzles 27 of the second nozzle group (nozzle group 26C) and the large dot LD is formed in the pixel position R1*p*1 of the raster position R1 by the nozzles 27 of the first nozzle group (nozzle group 23C), for example, displacement in an amount only corresponding to a difference between the center positions MC−SC occurs in the main scanning direction D1 between the large dot LD and the small dot SD. That is, according to the third embodiment, in addition to the advantages described in relation to the first embodiment, displacement in the formation position in the main scanning direction D1 between dots of different sizes is readily suppressed and, as a result, further improvement in image quality can be achieved.

Such a third embodiment can also be combined with the second embodiment. That is, the HT processing unit 14 may perform printing by generating one of the first HT data and the second HT data as the HT data specifying the presence or absence of the first size dot, generating the other as the HT data specifying the presence or absence of the second size dot smaller than the first size dot, and with respect to the image in which brightness in the image data IM1 belongs to the predetermined highlight range, and driving only the second nozzle group based on the second HT data specifying the presence or absence of the second size dot among the HT data specifying the presence or absence of the first size dot (the first HT data, for example) and the HT data specifying the presence or absence of the second size dot (the second HT data).

6. Other Embodiments

The invention is not limited to the embodiments described above, and may include other embodiments below, for example.

For example, the number of nozzle groups corresponding to ink of the same color of the print head 21 may be more than two (the first nozzle group and the second nozzle group). For example, the print head 21 may include more head chips than the head chips 23, 24, 25, 26 illustrated in FIG. 2, and the number of nozzle groups corresponding to ink of the same color may be three or more in correspondence with the respective CMYKs. Accordingly, this embodiment is the printing apparatus 1 configured to execute printing using the print head 21 provided with, on different head chips, a plurality of nozzle groups configured to eject ink of a same color, with at least a portion of each formation range of the nozzle groups corresponding to ink of the same color and formed on the different head chips overlapping each other, and the different head chips being disposed in a direction that crosses an alignment direction of the nozzles. The printing apparatus 1 includes the HT processing unit 14 that generates HT data specifying a presence or absence of dots for each pixel serving as data for driving the nozzle groups, based on image data. The HT processing unit 14 generates at least first HT data for driving a first nozzle group included in the plurality of nozzle groups corresponding to ink of the same color, and second HT data for driving a second nozzle group included in the plurality of nozzle groups, in an uncorrelated manner.

Further, when the plurality of nozzle groups corresponding to ink of the same color and formed on different head chips exist as, for example, the first nozzle group, the second nozzle group, and the third nozzle group, the first HT data for driving the first nozzle group, the second HT data for driving the second nozzle group, and the third HT data for driving the third nozzle group may be entirely generated in an uncorrelated manner in this embodiment (HT process of step S120). Alternatively, while the first HT data for driving the first nozzle group and the second HT data for driving the second nozzle group may be generated in an uncorrelated manner and the first HT data for driving the first nozzle group and the third HT data for driving the third nozzle group are generated in an uncorrelated manner, a case where the second HT data for driving the second nozzle group and the third HT data for driving the third nozzle group are correlated is also conceivable.

Further, while FIG. 2 illustrates an example in which the nozzle groups corresponding to each color of the print head 21 are symmetrically disposed along the main scanning direction D1, there is no necessity to have such a symmetrical arrangement, and a plurality of nozzle groups corresponding to ink of the same color may be formed on different head chips. Further, while two nozzle groups are formed in a single head chip in FIG. 2, three or more nozzle groups each corresponding to a different ink color may be formed on a single head chip.

Further, when the plurality of nozzle groups corresponding to ink of the same color exist as, for example, the first nozzle group, the second nozzle group, and the third nozzle group . . . , the first HT data for driving the first nozzle group may be generated as HT data specifying the presence or absence of the large dot LD, the second HT data for driving the second nozzle group may be generated as HT data specifying the presence or absence of the medium dot MD, and the third HT data for driving the third nozzle group may be generated as HT data specifying the presence or absence of the small dot SD. According to such a configuration, the occurrence timing of the driving waveform applied to each of the first nozzle group, the second nozzle group, and the third nozzle group is adjusted, making it possible to eliminate entire displacement (in the main scanning direction D1) between the large dot LD formed by the nozzles 27 of the first nozzle group, the medium dot MD formed by the nozzles 27 of the second nozzle group, and the small dot SD formed by the nozzles 27 of the third nozzle group.

The number of types of dots of different sizes configured to be ejected by the nozzle 27 may be greater than or less than three (large dot, medium dot, small dot). Further, the ink ejected by the print head 21 may include ink of colors other than CMYK.

The print head 21 illustrated in FIG. 2 is a so-called serial type that is moved by a carriage along the main scanning direction D1. However, this embodiment can also be applied to a printing apparatus that includes a print head of a so-called line type (line head) that is fixed to the printing unit 20 and prints on the printing medium P transported along the transport direction D2. Specifically, the nozzle alignment direction of each of the nozzle groups 23C, 23Y, 24M, 24K, 25K, 25M, 26Y, 26C is not parallel to the transport direction D2 as illustrated in FIG. 2, but rather the head chips 23, 24, 25, 26 are presumably arranged along the transport direction D2 to be parallel to the main scanning direction D1. In this case, the main scanning direction is referred to as a longitudinal direction of the line head.

Further, the plurality of nozzles 27 constituting the nozzle groups 23C, 23Y, 24M, 24K, 25K, 25M, 26Y, 26C are formed across a range corresponding to the width of the printing medium P along the longitudinal direction of the line head. In the printing apparatus including such a line head as well, errors may occur in the assembly of the head chips 23, 24, 25, 26 aligned along the transport direction D2, causing an error between nozzle groups in the longitudinal direction of the line head between the nozzle groups formed in different head chips configured to eject ink of the same color. Thus, the advantages of each of the embodiments described above can be achieved by applying this embodiment to a printing apparatus including the line head. Note that, when the third embodiment is applied to the printing apparatus including the line head, the displacement between dots of different sizes in the main scanning direction D1 described above is considered as the displacement between dots of different sizes in the transport direction D2.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having"

and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A printing control apparatus configured to control printing using a print head provided with, on different head chips, a plurality of nozzle groups including a first nozzle group and a second nozzle group configured to eject ink of a same color, with at least a portion of a formation range of each of the nozzle groups corresponding to ink of the same color and formed on the different head chips overlapping each other, and the different head chips being disposed in a direction that crosses an alignment direction of nozzles of each of the nozzle groups, the printing control apparatus comprising a halftone processing unit configured to generate halftone data specifying a presence or absence of dots per pixel serving as data to drive the nozzle groups based on image data, the halftone processing unit being further configured to generate first halftone data to drive the first nozzle group and second halftone data to drive the second nozzle group in an uncorrelated manner.

2. The printing control apparatus according to claim 1, wherein the halftone processing unit is further configured to generate the first halftone data and the second halftone data that drive either one of the first nozzle group and the second nozzle group corresponding to an image having brightness of a predetermined highlight range in the image data.

3. The printing control apparatus according to claim 1, wherein the halftone processing unit is configured to generate one of the first halftone data and the second halftone data by a dither method, and generate the other of the first halftone data and the second halftone data by an error diffusion method.

4. The printing control apparatus according to claim 1, wherein each nozzle of each of the nozzle groups is configured to eject a first size dot and a second size dot smaller than the first size dot, and the halftone processing unit is further configured to generate one of the first halftone data and the second halftone data as halftone data specifying a presence or absence of the first size dot, and the other of the first halftone data and the second halftone data as halftone data specifying a presence or absence of the second size dot.

5. A printing apparatus configured to execute printing using a print head provided with, on different head chips, a plurality of nozzle groups including a first nozzle group and a second nozzle group configured to eject ink of a same color, with at least a portion of a formation range of each of the nozzle groups corresponding to ink of the same color and formed on the different head chips overlapping each other, and the different head chips being disposed in a direction that crosses an alignment direction of nozzles of each of the nozzle groups, the printing apparatus comprising a halftone processing unit configured to generate halftone data specifying a presence or absence of dots per pixel serving as data to drive the nozzle groups based on image data, the halftone processing unit being further configured to generate first halftone data to drive the first nozzle group and second halftone data to drive the second nozzle group in an uncorrelated manner.

6. A printing control method for controlling printing using a print head provided with, on different head chips, a plurality of nozzle groups including a first nozzle group and a second nozzle group configured to eject ink of a same color, with at least a portion of a formation range of each of the nozzle groups corresponding to ink of the same color and formed on the different head chips overlapping each other, and the different head chips being disposed in a direction that crosses an alignment direction of nozzles of each of the nozzle groups, the printing control method comprising generating halftone data specifying a presence or absence of dots per pixel serving as data to drive the nozzle groups based on image data, the generating halftone data generating first halftone data to drive the first nozzle group and second halftone data to drive the second nozzle group in an uncorrelated manner.

* * * * *